US008412084B2

(12) United States Patent
Ishida et al.

(10) Patent No.: US 8,412,084 B2
(45) Date of Patent: Apr. 2, 2013

(54) FIXING DEVICE PROVIDED WITH TEMPERATURE SENSOR

(75) Inventors: Kei Ishida, Aichi (JP); Noboru Suzuki, Komaki (JP); Yoshihiro Miyauchi, Ama (JP); Tomohiro Kondo, Nagoya (JP); Yasushi Fujiwara, Itami (JP); Tsuneo Fujiwara, legal representative, Itami (JP); Etsuko Fujiwara, legal representative, Itami (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 38 days.

(21) Appl. No.: 12/956,691

(22) Filed: Nov. 30, 2010

(65) Prior Publication Data

US 2011/0150544 A1 Jun. 23, 2011

(30) Foreign Application Priority Data

Nov. 30, 2009 (JP) ..... 2009-271464

(51) Int. Cl.
*G03G 15/20* (2006.01)

(52) U.S. Cl. ..... 399/329

(58) Field of Classification Search ..... 399/98, 399/99, 101, 123, 343, 358, 329
See application file for complete search history.

(56) References Cited

U.S. PATENT DOCUMENTS

| | | | | |
|---|---|---|---|---|
| 7,881,650 | B2 * | 2/2011 | Shin et al. | 399/329 |
| 2005/0053390 | A1 * | 3/2005 | Suzuki et al. | 399/69 |
| 2009/0148207 | A1 * | 6/2009 | Yamada et al. | 399/331 |

FOREIGN PATENT DOCUMENTS

| | | |
|---|---|---|
| JP | 05-153353 | 6/1993 |
| JP | 08-286439 | 11/1996 |
| JP | 2000-350033 | 12/2000 |
| JP | 2006-251479 | 9/2006 |

* cited by examiner

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

There is provided a fixing device for thermally fixing a developing agent image to a sheet. The fixing device includes: a tubular flexible member having an inner peripheral surface defining an internal space; a nip member disposed in the internal space and having one surface, the inner peripheral surface being in sliding contact with the one surface; a heater disposed in the internal space: a reflection plate configured to reflect a radiant heat from the heater toward the nip member; a backup member providing a nip region in cooperation with the nip member for nipping the flexible member between the backup member and the nip member; and a temperature sensor disposed in the internal space to detect a temperature of the reflection plate.

3 Claims, 7 Drawing Sheets

FIXING DEVICE PROVIDED WITH TEMPERATURE SENSOR

CROSS REFERENCE TO RELATED APPLICATION

This application claims priority from Japanese Patent Application No. 2009-271464 filed Nov. 30, 2009. The entire content of the priority application is incorporated herein by reference. Further, the present application closely relates to co-pending U.S. Patent Application (based on Japanese Patent Application No. 2009-250235 filed October 30), another co-pending U.S. Patent Application (based on Japanese Patent Application No. 2009-250238 filed Oct. 30, 2009), still another co-pending U.S. Patent Application (based on Japanese Patent Application No. 2009-271451 filed Nov. 30, 2009), and still another co-pending U.S. Patent Application (based on Japanese Patent Application Nos. 2009-271459 filed Nov. 30, 2009 and 2009-271466 filed Nov. 30, 2009) which are incorporated by reference.

TECHNICAL FIELD

The present invention relates to a fixing device that thermally fixes a transferred developing agent image to a sheet.

BACKGROUND

A thermal fixing device has been proposed for an electrophotographic type image forming device. The fixing device includes a fixing belt, a heater such as a halogen lamp disposed at a space defined in an inner peripheral surface of the fixing belt, a nip plate, and a pressure roller. A nip region is defined between the nip plate and the pressure roller through the fixing belt. A temperature sensor is provided to detect a temperature in order to control the heater for controlling a fixing temperature. More specifically, a recessed portion is formed at a surface of the nip plate, with which the fixing belt is in sliding contact, and the temperature sensor such as a contact type thermistor is disposed in the recessed portion.

SUMMARY

In the fixing device, the temperature sensor desirably detects the temperature of the nip plate which is directly heated by the heater. However, the temperature sensor cannot be positioned to detect the temperature of the nip plate due to the spacial limitation in the internal space of the fixing belt. The inner peripheral surface of the fixing belt and the temperature sensor may be damaged or frictionally worn because the inner peripheral surface of the fixing belt is in sliding contact with the temperature sensor and open edges of the recessed portion during circular movement of the fixing belt.

Therefore, it is an object of the invention to provide a fixing device capable of providing a suitable position of the temperature sensor in the limited space.

In order to attain the above and other objects, there is provided a fixing device for thermally fixing a developing agent image to a sheet. The fixing device includes: a tubular flexible member having an inner peripheral surface defining an internal space; a nip member disposed in the internal space and having one surface, the inner peripheral surface being in sliding contact with the one surface; a heater disposed in the internal space: a reflection plate configured to reflect a radiant heat from the heater toward the nip member; a backup member configured to provide a nip region in cooperation with the nip member for nipping the flexible member between the backup member and the nip member; and a temperature sensor disposed in the internal space to detect a temperature of the reflection plate.

DETAILED DESCRIPTION

First, a general configuration of a laser printer 1 (an image forming device) common to first through fifth embodiments will be described with reference to FIG. 1. The laser printer 1 shown in FIG. 1 is provided with a fixing device 100 according to a first embodiment of the present invention.

Throughout the specification, the terms "above", "below", "right", "left", "front", "rear" and the like will be used assuming that the laser printer 1 is disposed in an orientation in which it is intended to be used. More specifically, in FIG. 1, a right side, a left side, a near side and a far side are to be referred to as a front side, a rear side, a left side and a right side, respectively.

Figure 1:
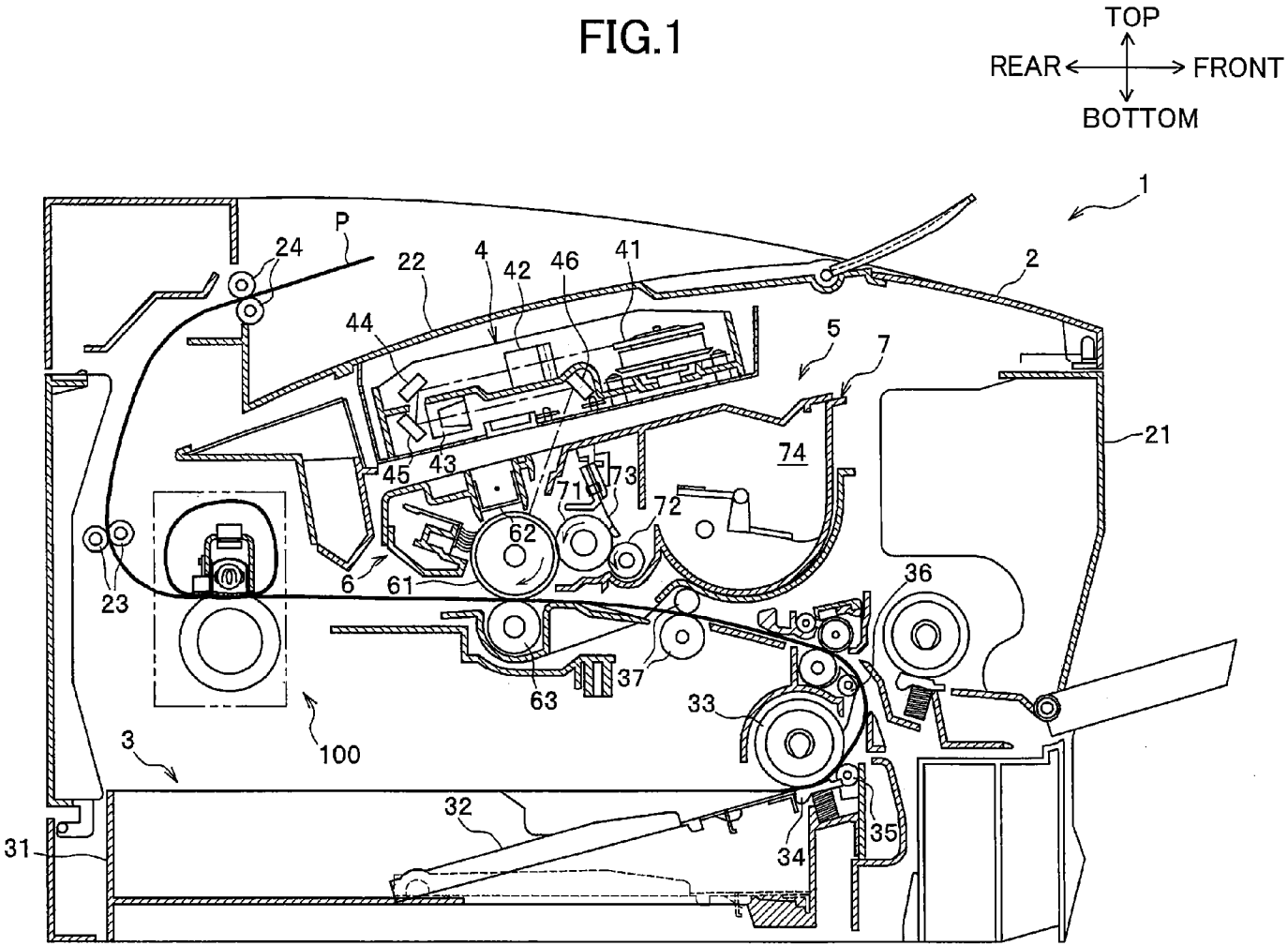
FIG. 1 is a schematic cross-sectional view showing a general configuration of a laser printer provided with a fixing device according to a first embodiment of the present invention.

As shown in FIG. 1, the laser printer 1 includes a main frame 2 provided with a movable front cover 21. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 after passing through the paper dust removing rollers 35, 36, and the registration rollers 37.

The exposure unit 4 is disposed at an upper portion of the main frame 2. The exposure unit 4 includes a laser emission unit (not shown), a polygon mirror 41, lenses 42, 43, and reflection mirrors 44, 45, 46. In the exposure unit 4, the laser emission unit emits a laser beam (indicated by a dotted line in FIG. 1) based on image data so that the laser beam is reflected by or passes through the polygon mirror 41, the lens 42, the reflection mirrors 44, 45, the lens 43, and the reflection mirror 46 in this order. A surface of a photosensitive drum 61 is exposed to high speed scan of the laser beam.

The process cartridge 5 is disposed below the exposure unit 4. The process cartridge 5 is detachably loadable in the main frame 2 through a front opening defined when the front cover 21 of the main frame 2 is opened. The process cartridge 5 includes a drum unit 6 and a developing unit 7.

The drum unit 6 includes the photosensitive drum 61, a charger 62, and a transfer roller 63. The developing unit 7 is detachably mounted on the drum unit 6. The developing unit 7 includes a developing roller 71, a toner supply roller 72, a thickness-regulation blade 73, and a toner accommodating portion 74 in which toner (developing agent) is accommodated.

In the process cartridge 5, after the surface of the photosensitive drum 61 has been uniformly charged by the charger 62, the surface is exposed to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is then conveyed between the developing roller 71 and the thickness-regulation blade 73 so as to be carried on the developing roller 71 as a thin layer having a uniform thickness.

The toner borne on the developing roller 71 is supplied to the electrostatic latent image formed on the photosensitive drum 61. Hence, a visible toner image corresponding to the electrostatic latent image is formed on the photosensitive drum 61. When the sheet P is then being conveyed between the photosensitive drum 61 and the transfer roller 63, the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 and is discharged onto a discharge tray 22 formed on an upper surface of the main frame 2.

Next, the fixing device 100 according to the first embodiment of the present invention will be described with reference to FIGS. 2 through 4.

Figure 2:
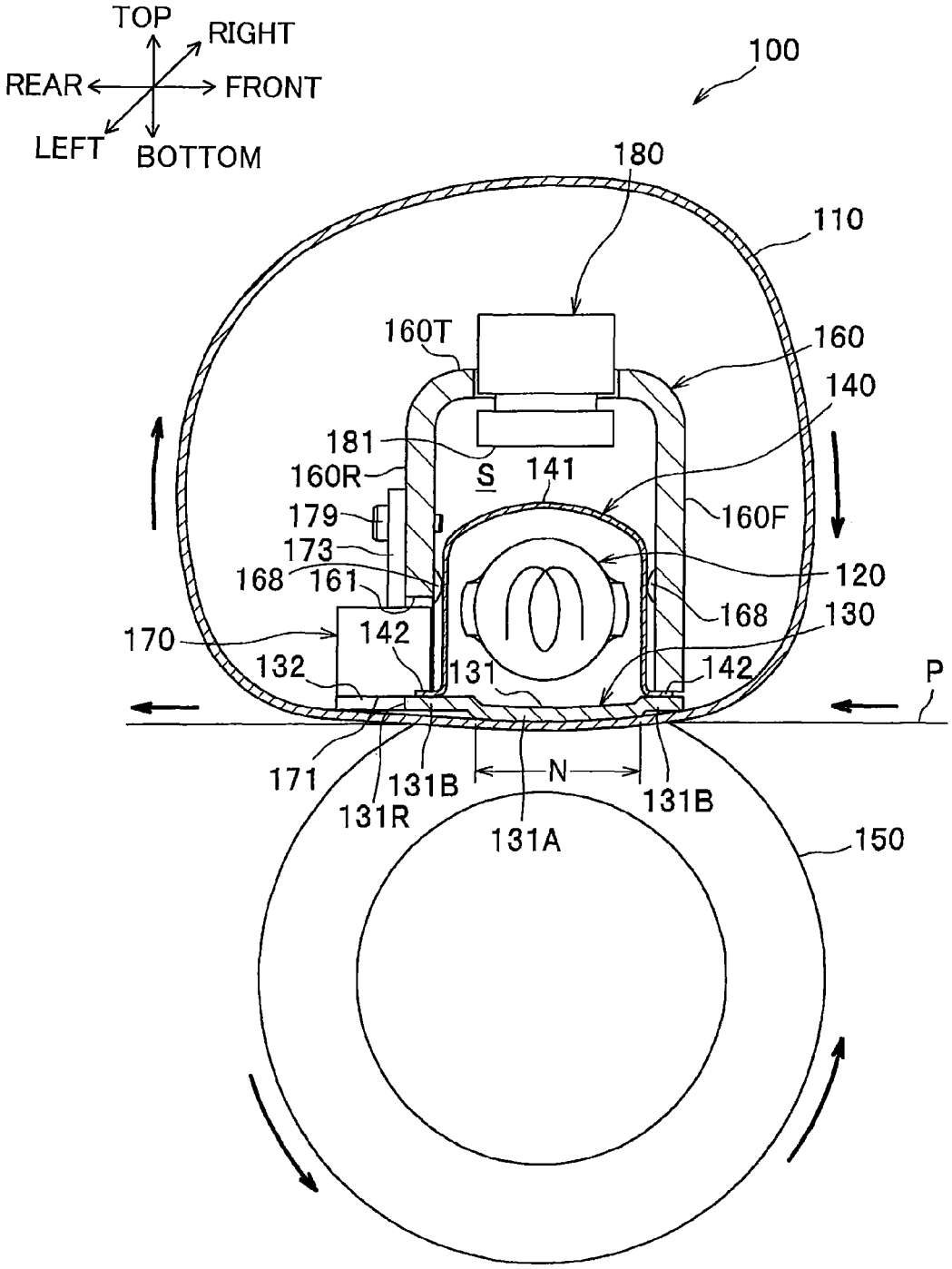
FIG. 2 is a schematic cross-sectional view of the fixing device according to the first embodiment.
Figure 3:
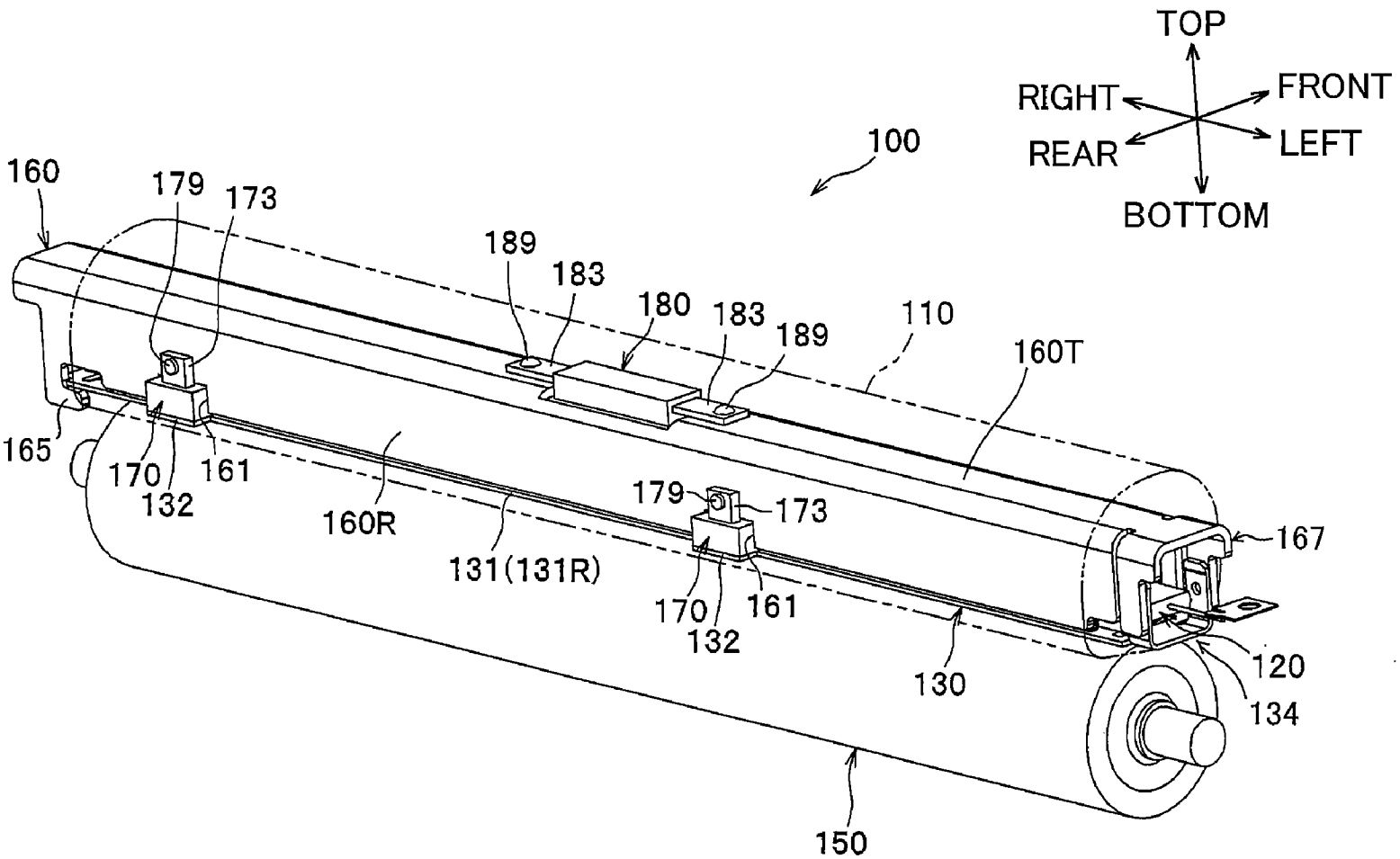
FIG. 3 is a perspective view of the fixing device according to the first embodiment.

As shown in FIGS. 2 and 3, the fixing device 100 includes a flexible tubular fusing member such as a tube or film 110, a halogen lamp 120 as a heater, a nip plate 130, a reflection plate as a reflection member 140, a pressure roller 150 as a backup member, a stay 160, and two thermistors 170, and a thermostat 180 as a claimed temperature sensor.

In the following description, frontward/rearward direction will be simply referred to as "sheet feeding direction", and lateral or rightward/leftward direction will be simply referred to as "widthwise direction" of the sheet P.

The fusing film 110 is of a tubular configuration having heat resistivity and flexibility. Each widthwise end portion of the tubular fusing film 110 is guided by a guide member (not shown) fixed to a casing (not shown) of the fixing device 100 so that the fusing film 110 is circularly movable. The fusing film 110 may be a metal film or a resin film. Alternatively, the fusing film 110 may be a film whose outer circumferential surface is coated with a rubber.

The halogen lamp 120 is a heater to heat the nip plate 130 to heat the fusing film 110 for heating toner on the sheet P. The halogen lamp 120 is positioned at an internal space of the fusing film 110 and is spaced away from an inner surface of the nip plate 130 by a predetermined distance.

The nip plate 130 is adapted for receiving pressure from the pressure roller 150 and for transmitting radiation heat from the halogen lamp 120 to the toner on the sheet P through the fusing film 110. To this effect, the nip plate 130 is stationarily positioned such that an inner peripheral surface of the fusing film 110 is moved slidably with a lower surface of the nip plate 130 through grease. The nip plate 130 may be in direct contact with the lower surface of the fusing film 110, or may be in contact with the same via a coating layer.

The nip plate 130 is made from a material such as aluminum having a thermal conductivity higher than that of the stay 160 (described later) made from a steel. The nip plate 130 has a base portion 131 and two protruding portions 132.

The base portion 131 has a center portion 131A in the sheet feeding direction and front and rear end portions 131B. The center portion 131A is protruding toward the pressure roller 150, and has an inner (upper) surface painted with a black color or provided with a heat absorbing member so as to efficiently absorb radiant heat from the halogen lamp 120.

The rear end portion 131B has a rear edge 131R from which two protruding portions 132 protrude rearward along the sheet feeding direction. As shown in FIG. 4, the protruding portions 132 are positioned at a right end portion and a center portion in the widthwise direction, respectively.

Figure 4:
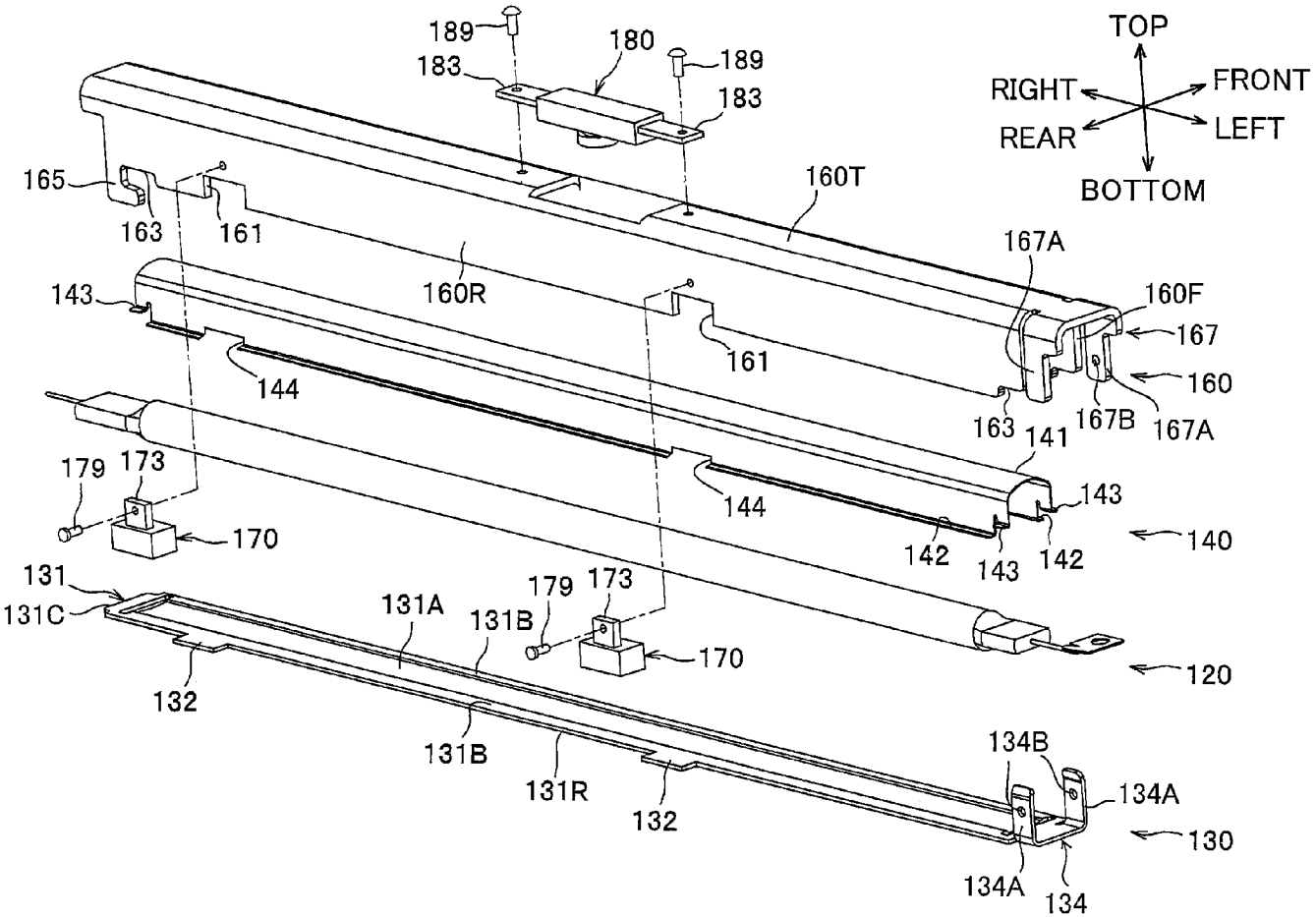
FIG. 4 is an exploded perspective view showing a halogen lamp, a nip plate, a reflection plate, a stay, two thermistors and a thermostat of the fixing device according to the first embodiment.

As shown in FIG. 4, the nip plate 130 has a right end portion provided with an insertion portion 131C extending flat, and a left end portion provided with an engagement portion 134. The engagement portion 134 has U-shaped configuration as viewed from a left side including side wall portions 134A extending upward and formed with engagement holes 134B.

The reflection plate 140 is adapted to reflect radiant heat radiating from the halogen lamp 120 toward the nip plate 130 (toward the inner surface of the base portion 131). As shown in FIG. 2, the reflection plate 140 is positioned within the fusing film 110 and surrounds the halogen lamp 120, with a predetermined distance therefrom. Thus, heat from the halogen lamp 120 can be efficiently concentrated onto the nip plate 130 to promptly heat the nip plate 130 and the fusing film 110.

The reflection plate 140 is configured into U-shape in cross-section and is made from a material such as aluminum having high reflection ratio regarding infrared ray and far infrared ray. The reflection plate 140 has a U-shaped reflection portion 141 and a flange portion 142 extending from each end portion of the reflection portion 141 in the sheet feeding direction. A mirror surface finishing is available on the surface of the aluminum reflection plate 140 for specular reflection in order to enhance heat reflection ratio.

As shown in FIG. 4, two engagement sections 143 are provided at each widthwise end of the reflection plate 140. Each engagement section 143 is positioned higher than the flange portion 142. Two notches 144 are formed at positions corresponding to the protruding portions 132.

The pressure roller 150 is positioned below the nip plate 130 and nips the fusing film 110 in cooperation with the nip plate 130 to provide a nip region N for nipping the sheet P between the pressure roller 150 and the fusing film 110. In other words, the pressure roller 150 presses the nip plate 130 through the fusing film 110 for providing the nip region N between the pressure roller 150 and the fusing film 110.

The pressure roller 150 is rotationally driven by a drive motor (not shown) disposed in the main frame 2. By the rotation of the pressure roller 150, the fusing film 110 is circularly moved along the nip plate 130 because of the friction force generated therebetween or between the sheet P and the fusing film 110. A toner image on the sheet P can be thermally fixed thereto by heat and pressure during passage of the sheet at the nip region N between the pressure roller 150 and the fusing film 110.

The stay 160 is adapted to support the end portions 131B of the nip plate 130 for maintaining rigidity of the nip plate 130. The stay 160 has a U-shape configuration having a front wall 160F, a rear wall 160R and a top wall 160T in conformity with the outer shape of the reflection portion 141 covering the reflection plate 140. For fabricating the stay 160, a highly rigid member such as a steel plate is folded into U-shape to have the top wall 160T, the front wall 160F and the rear wall 160R.

As shown in FIG. 4, each of the front wall 160F and the rear wall 160R has a lower end portion 163.

As a result of assembly of the nip plate 130 together with the reflection plate 140 and the stay 160, the lower end portions 163 of the front wall 160F and the rear wall 160R are nipped between the right and left engagement sections 143. That is, the right engagement section 143 is in contact with the right lower end portion 163, and the left engagement section 143 is in contact with the left lower end portion 163. As a result, displacement of the reflection plate 140 in the widthwise direction due to vibration caused by operation of the fixing device 100 can be restrained by the engagement between the engagement sections 143 and the lower end portions 163.

The front and rear walls 160F, 160R have right end portions provided with L shaped engagement legs 165 each extending downward and then leftward. The insertion portion 131C of the nip plate 130 is insertable into a space between the confronting engagement legs 165 and 165. Further, each end portion 131B of the base portion 131 is abuttable on each engagement leg 165 as a result of the insertion.

The top wall 160T has a left end portion provided with a retainer 167 having U-shaped configuration. The retainer 167 has a pair of retaining walls 167A whose inner surfaces are provided with engagement bosses 167B each being engageable with each engagement hole 134B.

As shown in FIG. 2, each widthwise end portion of each of the front wall 160F and the rear wall 160R has an inner surface provided with two abutment bosses 168 protruding inward in abutment with the front and rear side walls of the reflection portion 141 in the sheet feeding direction. Therefore, displacement of the reflection plate 140 in the sheet feeding direction due to vibration caused by operation of the fixing device 100 can be restrained because of the abutment of the reflection portion 141 with the bosses 168.

A thinly-layered gap S is defined between an inner surface of the stay 160 and the outer surface of the reflection plate 140. The gap S can restrain heat loss which may occur due to inflow of external cooled air. Further, air in the gap S does not easily flow outside, so that the air can function as a heat retaining layer upon heating, which prevent heat from releasing from the reflection plate 140 to outside. Consequently, heating efficiency to the nip plate 130 can be improved to promptly heat the nit plate 130 (the nip region N).

As shown in FIGS. 3 and 4, the rear wall 160R of the stay 160 is formed with two notches 161 for positioning the two thermistors 170 at positions in alignment with the two protruding portions 132 of the nip plate 130. Further, each notch 161 is sized to provide a minute clearance from the thermistor 170 (to avoid contact with the thermister 170).

A conventional temperature sensor is used as the thermistor 170 for detecting a temperature of the nip plate 130. More specifically, as shown in FIGS. 2 and 3, the two thermistors 170 are positioned within a space defined by the inner peripheral surface of the fusing film 110, and each thermistor 170 has an upper portion provided with a fixing rib 173 fixed to the rear wall 160R by a thread 179, and has a lower surface in direct confrontation with an upper surface of the corresponding protruding portion 132. The upper surface of the protruding portion 132 is a surface opposite to a surface in sliding contact with the fusing film 110. The lower surface of the thermister 170 functions as a temperature detection surface 171 in contact with the upper surface of the protruding portion 132. Each notch 144 prevents the thermistor 170 on the protruding portion 132 from directly seating on the flange portion 142.

Further, as shown in FIG. 2, each thermistor 170 is positioned outside of the reflection portion 141 of the reflection plate 140 in the sheet feeding direction. More specifically, each thermistor 170 is positioned outside of the nip region N and downstream of (rear side of) the reflection plate 140 in the sheet feeding direction. Further, each thermister 170 is spaced away from the outer surface of the reflection portion 141 of the reflection plate 140 to avoid direct contact therewith.

A control unit (not shown) is provided in the main frame 2, and each thermistor 170 is connected to the control unit for transmitting a detection signal to the control unit. Thus, a fixing temperature at the nip region N can be controlled by controlling an output of the halogen lamp 120 or by ON/OFF control to the halogen lamp 120 based on the signal indicative of the detected temperature. Such control is well known in the art.

A conventional temperature detection element such as a bimetal is available as the thermostat 180 for detecting the temperature of the reflection plate 140. More specifically, the thermostat 180 is positioned within the space defined by the inner peripheral surface of the fusing film 110, and the thermostat 18 has each widthwise end portion provided with a fixing piece 183 fixed to the top wall 160T of the stay 160 by threads 189 as shown in FIG. 3, such that the thermostat 180 is positioned above the reflection plate 140. The thermostat 180 has a lower surface functioning as a temperature detection surface 181 in direct confrontation with the reflection plate 140. In other words, the thermostat 180 is positioned opposite to the halogen lamp 120 with respect to the reflection plate 140.

Here, the reflection plate 140 exhibits temperature elevation in a manner similar to that of the nip plate 130, because the reflection plate 140 directly receives radiant heat from the halogen lamp 120 similar to the nip plate 130. In the present embodiment, a distance between the halogen lamp 120 and the center portion 131A of the nip plate 130 is approximately equal to that between the halogen lamp 120 and the upper portion of the reflection portion 141 of the reflection plate 140. Accordingly, temperature elevating tendency of the reflection plate 140 is similar to that of the nip plate 130. Consequently, state of the halogen lamp 120, i.e., the temperature of the halogen lamp 120 can be detected by the detection of the temperature of the reflection plate 140 by means of the thermostat 180.

The thermostat 180 is provided in a power supply circuit supplying electric power to the halogen lamp 120, and is adapted to shut-off electric power supply to the halogen lamp 120 upon detection of a temperature exceeding a predetermined temperature. Thus, excessive temperature elevation at the fixing device 100 can be prevented.

Incidentally, rapid temperature elevation of the reflection plate 140 itself does not occur because the reflection plate 140 is a member for reflecting radiant heat from the halogen lamp 120 to the nip plate 130. Therefore, time difference occurs between a time period starting from the electric power supply timing to the halogen lamp 120 and ending at a timing where the temperature of the nip region N becomes a predetermined elevated temperature and a time period starting from the electric power supply timing to the halogen lamp 120 and ending at a timing where the temperature of the reflection plate 140 becomes a predetermined elevated temperature. To compensate this time difference, a specific thermostat 180 exhibiting optimum temperature detection range should be selected, or black color coating should be provided on the temperature detection surface 181 to facilitate heat absorption.

When assembling the reflection plate 140 and the nip plate 130 to the stay 160 to which the thermistors 170 and the thermostat 180 are fixed, first, the reflection plate 140 is temporarily assembled to the stay 160 by the abutment of the outer surface of the reflection portion 141 on the abutment bosses 168. In this case, the engagement sections 143 are in contact with the lower end portions 163.

Then, as shown in FIG. 3, the insertion portion 131C is inserted between the engagement legs 165 and 165, so that the base portion 131 can be brought into engagement with the engagement legs 165. Thereafter, the engagement bosses 167B are engaged with the engagement holes 134B. By this engagement, each flange portion 142 is sandwiched between the nip plate 130 and the stay 160. Thus, the nip plate 130 and the reflection plate 140 are held to the stay 160.

Each flange portion 142 of the reflection plate 140 is sandwiched between the stay 160 and each end portion 131B of the nip plate 130. Thus, vertical displacement of the reflection plate 140 due to vibration caused by operation of the fixing device 100 can be restrained to fix the position of the reflection plate 140 relative to the nip plate 130 and to maintain rigidity of the reflection plate 140.

Incidentally, the stay 160 holding the nip plate 130 and the reflection plate 140 and the halogen lamp 120 are held to the guide member (not shown) that guides circular movement of the fusing film 110. The guide member is fixed to the main casing (not shown) of the fixing device 100. Thus, the fusing film 110, the halogen lamp 120, the nip plate 130, the reflection plate 140, and the stay 160 are held to the main casing of the fixing device 100.

The fixing device 100 according to the above-described embodiment provides the following advantages and effects:

Enhanced degree of freedom in layout of the thermostat 180 can be obtained in comparison with a case where a thermostat is positioned to detect a temperature of the nip plate 130, because the thermostat 180 is positioned to detect the temperature of the reflection plate 140. In this way, restrictions on space for disposing the thermostat 180 can be removed, leading to efficient utilization of the internal space of the fusing film 110.

Further, no sliding contact between the fusing film 110 and the thermostat 180 occurs, thereby avoiding damage to and frictional wearing of the fusing film 110 and the thermostat 180.

Further, the thermostat 180 does not become an obstacle against radiant heat from the halogen lamp 120 toward the nip plate 130 and the reflection plate 140 and radiant heat reflected at the reflection plate 140 toward the nip plate 130, because the thermostat 180 is positioned opposite to the halogen lamp 120 with respect to the reflection plate 140. Accordingly, prompt heating to the nip plate 130 can be obtained to accelerate startup timing of the fixing device 100.

Further, assuming that a thermostat and a halogen lamp are positioned at the same side of the reflection plate, sufficient heat resistivity is required in the thermostat. However, in the first embodiment, improvement on heat resistivity is not required in the thermostat 180 because the thermostat 180 is positioned opposite to the halogen lamp 120 with respect to the reflection plate 140. Accordingly, the thermostat 180 can be produced at a low cost.

Any damage to the fusing film 110 and the thermistor 170 such as scratches and frictional wearing can be restrained since direct frictional contact between the fusing film 110 and the thermistor 170 does not occur during circular movement of the fusing film 110. This is due to the fact that the thermistor 170 is positioned on the upper surface of the nip plate 130, the upper surface being opposite to the surface with which the fusing film 110 is in sliding contact.

The thermistor 170 is not directly affected by the radiant heat from the halogen lamp 120, because the thermistor 170 is positioned outside of the reflection plate 140 in the sheet feeding direction. Consequently, the thermistor 170 can accurately detect the temperature of the nip plate 130 to enhance accuracy of temperature control.

Further, improvement on heat resistivity is not required in the thermistor 170 to reduce production cost, because the thermistor 170 is positioned outside of the reflection plate 140. If the thermistor were to be positioned within an interior of the reflection plate 140, such thermistor requires high heat resistivity.

Radiant heat from the halogen lamp 120 and the reflection plate 140 can be efficiently concentrated on the nip plate 130 without being interrupted by the thermistor 170, because the thermistor 170 is positioned outside of the reflection plate 140. Consequently, prompt heating to the nip plate 130 can be performed to accelerate startup timing of the fixing device 100.

Particularly, such radiant heat can be concentrated to the center portion 131A of the nip plate 130 because the thermistor 170 is positioned outside of the nip region N. Thus, temperature elevation of the nip region N can occur stably and uniformly, thereby improving thermal fixing operation.

The internal space of the fusing film 110 can be efficiently utilized because the thermistor 170 is positioned downstream of the reflection plate 140 in the sheet feeding direction. More specifically, a portion of the fusing film 110 immediately upstream of the nip region N is subjected to tensile force, whereas a portion of the fusing film 110 immediately downstream of the nip region N is slackened because of the rotation of the pressure roller 150. Therefore, a sufficient internal space can be provided at the downstream side of the reflection plate 140 because of the slacking of the fusing film 110. Consequently, the thermistor 170 can be positioned at the slackened space portion of the fusing film 110.

Further, the internal space of the fusing film 110 can be compact to reduce a circumferential length of the fusing film 110, because no particular space is required for installing the thermistor 170. Accordingly, a circularly moving cycle of the fusing film 110 can be reduced to restrain heat release from the fusing film 110, thereby accelerating startup timing of the fixing device 100.

Further, in the nip plate 130, a protruding section having an extending length equal to a widthwise length of the rear edge 131R and protruding rearward from the rear edge 131R is not provided, but a plurality of protruding portions 132 spaced away from each other in the widthwise direction are provided for mounting the thermistors 170 thereon. Therefore, a volume or heat capacity of the nip plate 130 can be reduced. Accordingly prompt heating to the nip plate 130 can be attained to accelerate startup timing of the fixing device 100.

Further, heat transmission from the halogen lamp 120 to the thermistor 170 through the reflection plate 140 can be restrained because of the gap defined between the thermistor 170 and the reflection plate 140. Accordingly, the thermistor 170 can accurately detect the temperature of the nip plate 130, to improve accuracy of the temperature control. Also the production cost of the thermistor 170 can be saved because sufficient heat resistivity of the thermistor is not required.

A compact installation of the thermistor 170 can be provided without enlarging the internal gap S, particularly without enlarging a gap between the outer surface of the reflection plate 140 and the inner surface of the stay 160 in the sheet feeding direction, because the notch 161 is formed in the stay 160 for the installation of the thermistor 170. Consequently, heat retention at the internal gap S can be obtained.

Further, the thermistor 170 can be positioned in the vicinity of the center portion 131A of the nip plate 130, i.e., in the vicinity of the nip region N, because of the formation of the notch 161 in the stay 160 for installing the thermistor 170. Accordingly, a response of the thermistor 170 can be improved, thereby improving accuracy in temperature control.

Further, the nip plate 130 can be downsized in the sheet feeding direction in comparison with a case where a thermistor is positioned outside of the stay 160 in the sheet feeding direction. Accordingly, heat capacity of the nip plate 130 can be lowered, thereby accelerating heating to the nip plate 130 to accelerate startup timing of the fixing device 100.

The temperature of the halogen lamp 120 can be accurately detected by the thermistor 170 through the nip plate 130, because the thermistor 170 is disposed to detect the temperature of the nip plate 130 which is directly heated by the halogen lamp 120. Accordingly, accuracy in temperature control can be improved.

Figure 5:
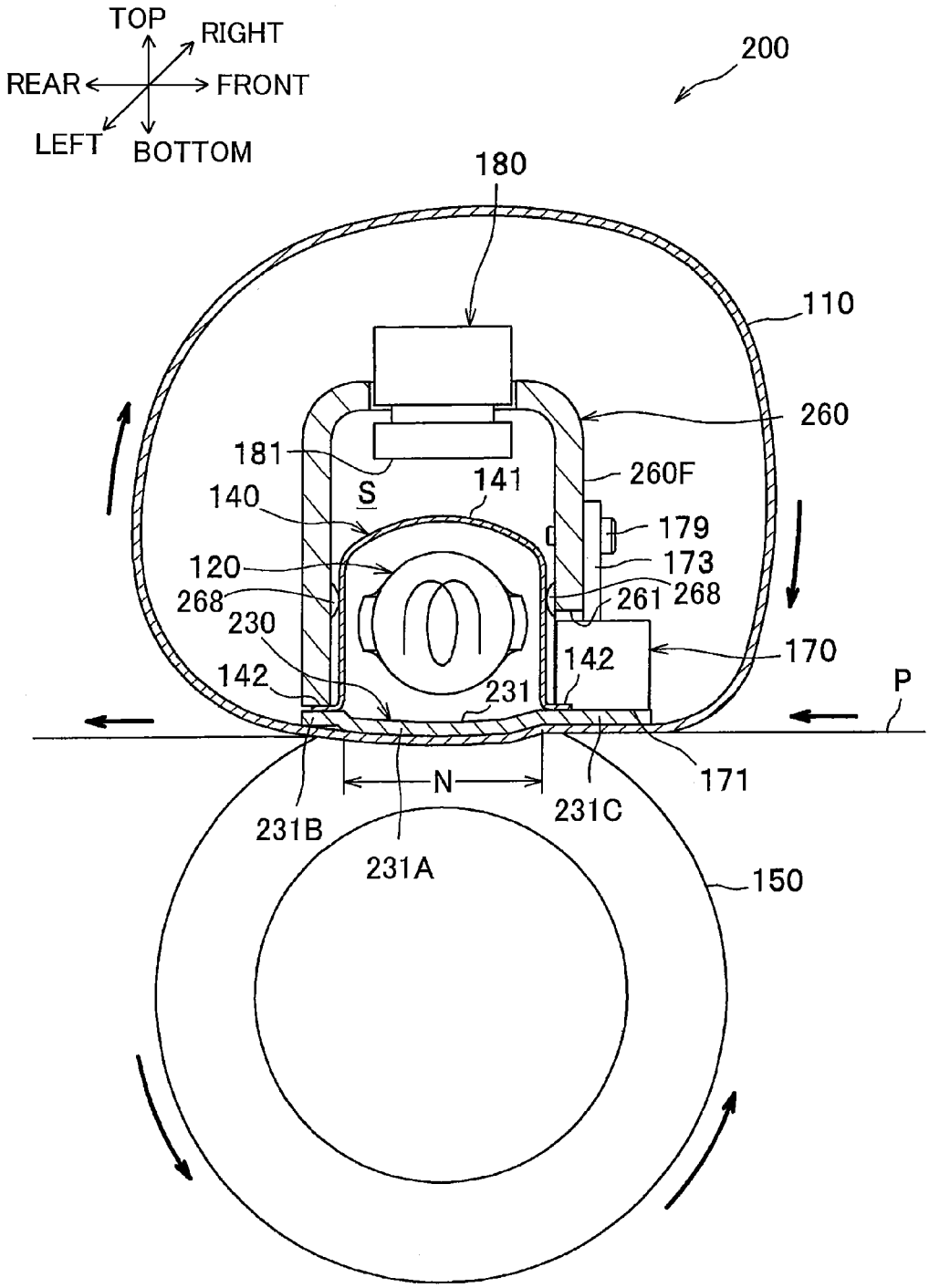
FIG. 5 is a schematic cross-sectional view of a fixing device according to a second embodiment of the present invention.

A fixing device 200 according to a second embodiment is shown in FIG. 5, where the thermistor 170 is positioned upstream of the reflection plate 140 in the sheet feeding direction.

To this effect, a stay 260 has a front wall 260F formed with a notch 261 through which the thermistor 170 is inserted. A nip plate 230 has a front elongated portion 231C extending frontward from a center portion 231A. The front elongated portion 231C can function as a preheat portion in contact with the inner peripheral surface of the fusing film 110 for preheating a portion of the fusing film 110, the portion being immediately upstream of the nip region N, thereby improving image-fixing performance.

Further, since the thermistor 170 is mounted on an upper surface of the front elongated portion (preheat portion) 231C, an inner space defined in the fusing film 110 can be efficiently utilized for installing the thermistor 170. That is, the space defined in the fusing film 110 can be reduced, because a particular space is not required for installing the thermistor 170, thereby reducing a peripheral length of the fusing film 110. Accordingly, circular moving cycle of the fusing film can be reduced to restrain heat release from the fusing film 110, thereby accelerating startup timing of the fixing device 200.

Figure 6A:
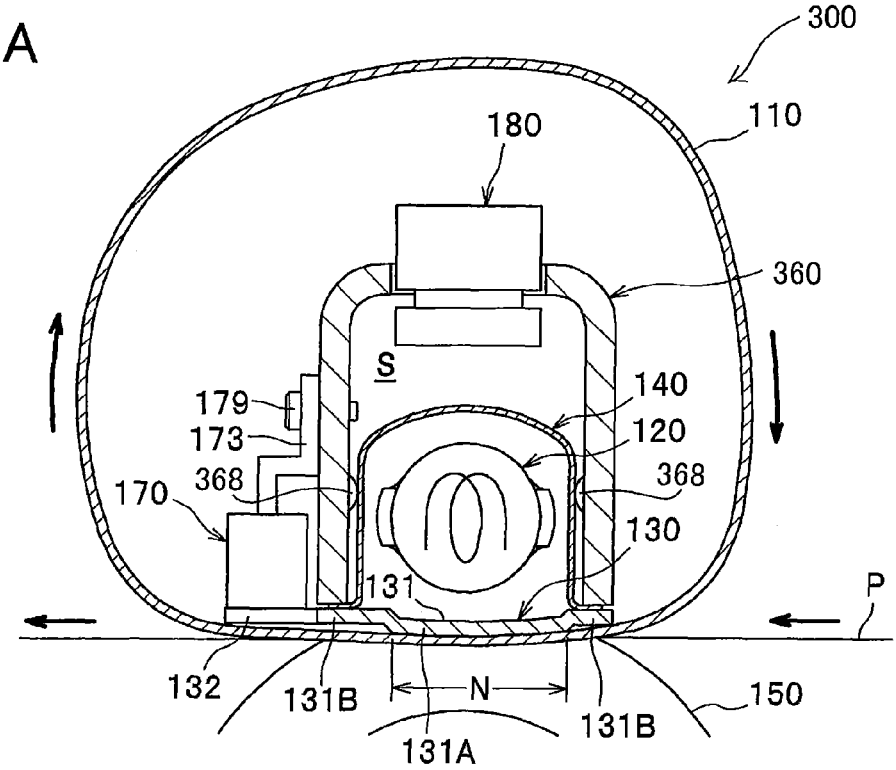
FIG. 6A is a partially-enlarged schematic cross-sectional view of a fixing device according to a third embodiment of the present invention.
Figure 6B:
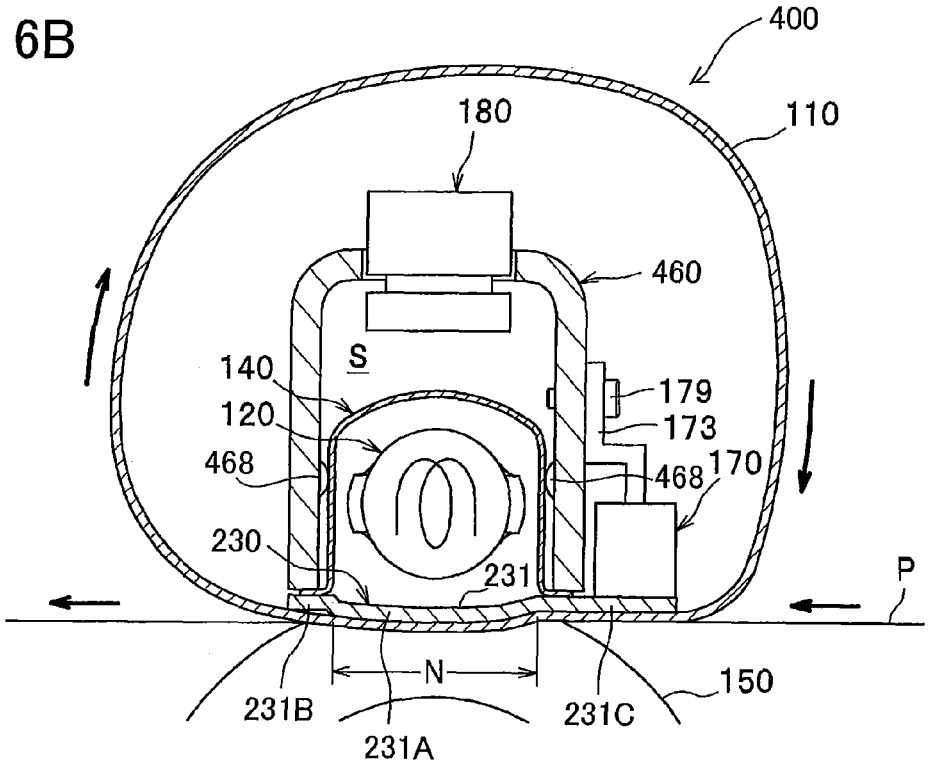
FIG. 6B is a partially-enlarged schematic cross-sectional view of a fixing device according to a fourth embodiment of the present invention.

A fixing device 300 according to a third embodiment is shown in FIG. 6A, where a stay 360 is not formed with a notch, but the thermistor 170 is disposed outside of the stay 360 at a position downstream of the stay 360 in the sheet feeding direction. Further, in a fixing device 400 according to a fourth embodiment shown in FIG. 6B, a stay 460 is not formed with a notch, but the thermistor 170 is disposed outside of the stay 360 at a position upstream of the stay 460 in the sheet feeding direction. To this effect, the nip plate 230 of the second embodiment should be employed as a nip plate to have the same effects as the second embodiment.

Figure 7:
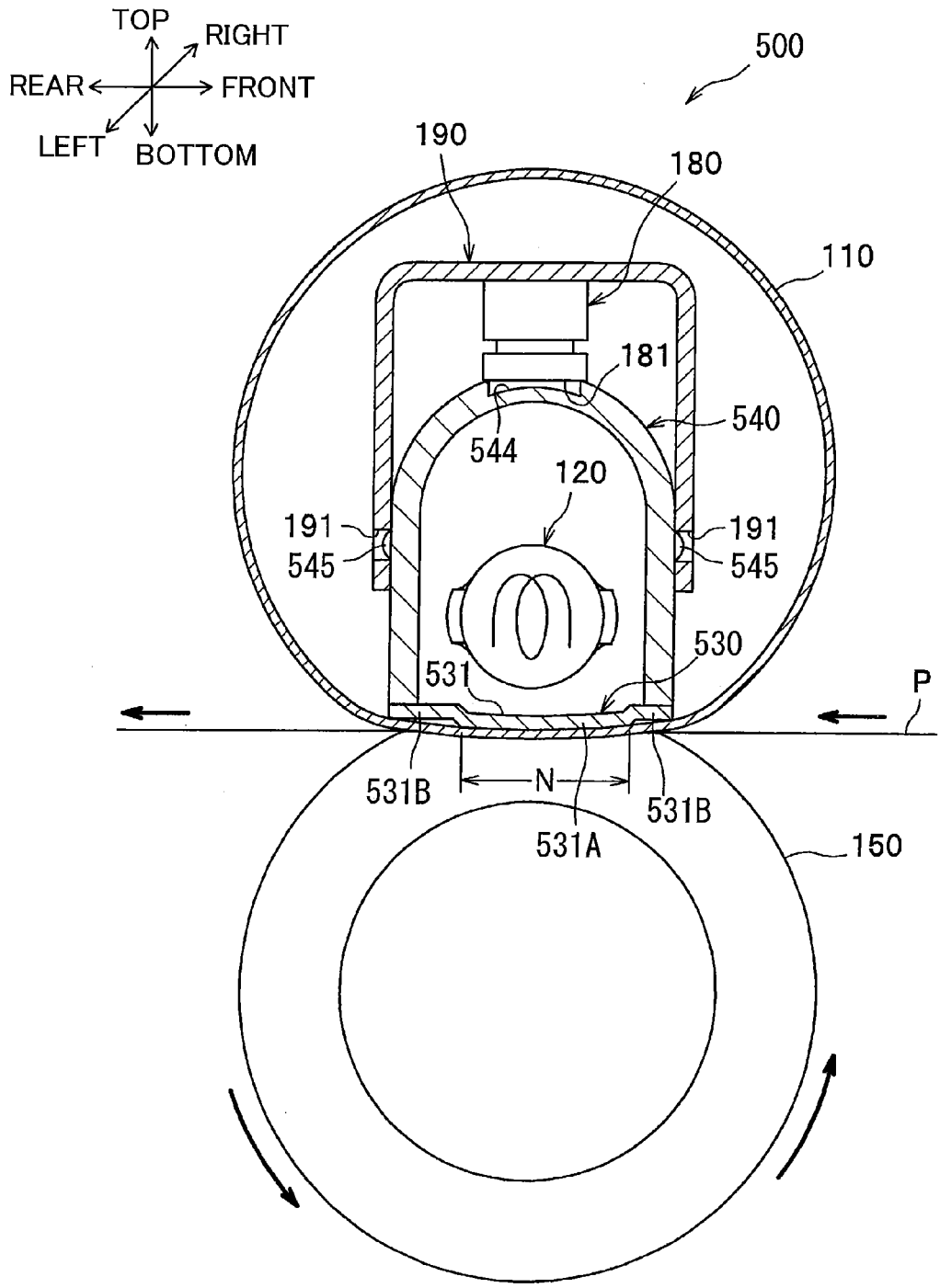
FIG. 7 is a schematic cross-sectional view of a fixing device according to a fifth embodiment of the present invention.

A fixing device 500 according to a fifth embodiment is shown in FIG. 7 in which the above-described stay is not provided. Instead, a reflection plate 540 having a sufficient rigidity is used as long as such reflection plate 540 can ensure rigidity of the nip plate 530. For example, the reflection plate 540 has a thickness greater than that of the foregoing embodiments. In other words, the reflection plate 540 also provides a function of the stay in addition to its inherent reflecting function. Alternatively, the stay can also be dispensed with by employing a nip plate having a sufficient rigidity.

Further, in the first through fourth embodiments, the reflection plate 140 has a thickness uniform along its profile having a top wall and vertical walls as shown in FIGS. 2, 5, 6A and 6B. However, in the fifth embodiment, a thickness of the top wall in direct confrontation with the thermostat 180 is smaller than that of the vertical walls, such that a surface of the top wall in direct confrontation with the thermostat 180 is formed with a recess 544 as shown in FIG. 7. With this structure, adjustment to detection accuracy and response of the thermostat 180 can be improved.

Here, an area of the recess 544 in plan view is smaller than that of the temperature detection surface 181 to facilitate positioning of the thermostat 180 in the vertical direction, because the temperature detection surface 181 can be in abutment with an open edge of the recess 544. Incidentally, the area of the recess 544 can be equal to or greater than the area of the temperature detection surface 181.

Further, according to the fifth embodiment, the thermostat 180 is fixed to a U-shaped support member 190 by threads or adhesive agent (not shown). The support member 190 is formed with a plurality of engagement holes 191, and the reflection plate 540 has fixing bosses 545. By engaging the fixing bosses 545 with the engagement holes 191, the support member 190 is fixed to the reflection member 540.

Various modifications are conceivable. For example, in the above-described embodiments, the thermostat 180 is positioned above the reflection plate 140. However, the thermostat 180 can be positioned ahead of (upstream of) or behind (downstream of) the reflection plate 140 in the sheet feeding direction. Further, the temperature sensor (thermostat) can be positioned at an internal space of the reflection plate where the heater is also positioned, as long as the sensor can detect the temperature of the reflection plate.

Further, an infrared ray heater or carbon heater is available instead of the halogen lamp 120.

Further, in the above-described embodiment, a single member is provided to form the nip plate 130. However, a plurality of members can be provided to form the nip plate 130.

Further, in the above-described embodiments, two protruding portions 132 are provided at the nip plate 130 for mounting thereon two thermistors 170. However, at least one of the end portions 131B can protrude frontward or rearward for mounting thereon the thermistor(s). Further, a single or at least three protruding portions 132 can be provided.

In the above-described embodiments, the base portion 131 has a downwardly projecting shape such that the center portion 131A is positioned lower than the end portions 131B. However, the center portion can be positioned higher than the end portions. Alternatively, a flat nip plate is also available.

In the depicted embodiments, the pressure roller 150 is employed as a backup member. However, a belt like pressure member is also available. Further, in the depicted embodiments, the nip region N is provided by the pressure contact of the backup member (pressure roller 150) against the nip member (the nip plate 130). However, a nip region can also be provided by a pressure contact of the nip member against the backup member.

Further, a non-contact type temperature sensor having a detection surface spaced away from the nip plate 130 can be employed instead of the contact type temperature sensor (the thermister 170) used in the foregoing embodiments.

In the foregoing embodiments, the thermostat 180 is used as the temperature sensor. However, a thermal fuse and a thermistor are also available. Incidentally, difference in time period occurs between a time period starting from the start timing of the heat radiation from the heater 120 and ending at a timing where the temperature of the nip region N becomes a predetermined elevated temperature and a time period starting from the start timing and ending at a timing where the temperature of the reflection plate 140 becomes a predetermined elevated temperature. To compensate this time difference, a temperature control can be performed with setting a compensation formula in case of the employment of a temperature sensor capable of detecting a temperature with time (such as a thermister). Further, the numbers of the sensors can be varied in accordance with the size and cost of the fixing device.

In the above-described embodiment, two notches 161 are formed in the stay 160. However, a through-hole is available instead of the notch 161.

Further, the sheet P can be an OHP sheet instead of a plain paper and a postcard.

Further, in the depicted embodiments, the image forming device is the monochromatic laser printer. However, a color laser printer, an LED printer, a copying machine, and a multifunction device are also available.

While the invention has been described in detail with reference to the embodiments thereof, it would be apparent to those skilled in the art that various changes and modifications may be made therein without departing from the spirit of the invention.

What is claimed is:

1. A fixing device for thermally fixing a developing agent image to a sheet comprising:

a tubular flexible member having an inner peripheral surface defining an internal space;

a nip member disposed in the internal space and having one surface, the inner peripheral surface being configured to be in sliding contact with the one surface;

a heater disposed in the internal space:

a reflection plate configured to reflect a radiant heat from the heater toward the nip member;

a backup member configured to provide a nip region in cooperation with the nip member for nipping the flexible member between the backup member and the nip member; and a temperature sensor disposed in the internal space of the tubular flexible member to detect a temperature of the reflection plate, the temperature sensor having a temperature detection surface that faces the reflection plate.

2. The fixing device as claimed in claim 1, wherein the temperature sensor is positioned opposite to the heater with respect to the reflection plate.

3. The fixing device as claimed in claim 2, wherein the temperature sensor is positioned in direct confrontation with the reflection plate; and wherein the reflection plate has a confronting region in direct confrontation with the temperature sensor and has a remaining region, the confronting region having a thickness smaller than that of the remaining region.

* * * * *